United States Patent [19]

Samuelson

[11] Patent Number: 4,676,295

[45] Date of Patent: Jun. 30, 1987

[54] METHOD AND APPARATUS FOR THE PRODUCTION OF CASTINGS

[75] Inventor: Sven-Erik Samuelson, Kil, Sweden

[73] Assignee: Asea Aktiebolag, Västeras, Sweden

[21] Appl. No.: 825,670

[22] Filed: Feb. 3, 1986

[30] Foreign Application Priority Data

Feb. 6, 1985 [SE] Sweden ..... 8500545

[51] Int. Cl.[4] ..... B22D 18/00

[52] U.S. Cl. ..... 164/119; 164/66.1; 164/303

[58] Field of Search ..... 164/119, 66.1, 307, 164/306, 303, 335, 136, 133, 308, 312, 318; 222/593, 595, 603, 591, 596, 606

[56] References Cited

U.S. PATENT DOCUMENTS

| | | | |
|---|---|---|---|
| 2,745,153 | 5/1956 | Burkett | 222/593 |
| 4,010,876 | 3/1977 | Steinemann | 222/595 |
| 4,153,100 | 5/1979 | Balevski | 164/306 |

FOREIGN PATENT DOCUMENTS

| | | | |
|---|---|---|---|
| 585947 | 10/1959 | Canada | 164/303 |
| 1076334 | 2/1960 | Fed. Rep. of Germany . | |
| 1083025 | 6/1960 | Fed. Rep. of Germany . | |

*Primary Examiner*—Nicholas P. Godici
*Assistant Examiner*—G. M. Reid
*Attorney, Agent, or Firm*—Watson, Cole, Grindle & Watson

[57] ABSTRACT

A method and apparatus in the production of metallic castings in which metal in molten state is fed from a heated container to a mold or a smaller container via a pressure pipe, a pressure-generating means and a suction pipe. The temperature of the metal, which is present in the suction pipe, in the pressure-generating means and in the pressure pipe, is controlled by heat-generating means in order to keep the metal at a temperature corresponding to or exceeding its melting point, so that the metal is present in molten state during its passage through the pipes and the pressure-generating means.

14 Claims, 2 Drawing Figures

METHOD AND APPARATUS FOR THE PRODUCTION OF CASTINGS

TECHNICAL FIELD

The present invention relates to a method in the production of metallic castings in which metal in molten state is fed from a heated container to a pressure-generating means via a tube. The invention also relates to a casting plant for carrying out the method.

The present invention aims to improve the operating conditions in a casting plant so as to make it reliable in operation, give it a long service life and enable it to be utilized for all the commonly-occurring casting methods, while at the same time improving the quality of the cast end products produced with such plant.

From Mahle-Werke GmbH German Pat. DE Nos. 1 076 334 and DE 1 083 025 and from Steinemann U.S. Pat. No. 4,010,876, it is known, in a die-casting machine, to heat the filling piston and the pressure chamber and to protect the melt by an inert gas.

SUMMARY OF THE INVENTION

The novelty of the method according to the invention mainly consists in the fact that the temperature of the metal, located in the pressure-generating means and in the melt supply tubes is controlled by heat-generating means in order to maintain the metal at a temperature equal to or exceeding its melting point, whereby it is ensured the metal is present in its molten state during its passage through the pressure-generating means and the tube system.

A casting plant according to the invention is characterized in that it comprises heat-generating means arranged to control the temperature of the metal present in the pressure-generating means and in the tube system in order to maintain the metal at a temperature equal to or exceeding its melting point, in that the metal is present in molten state during its passage through the pressure-generating means and the tube system, and in that a protective medium surrounds at least the pressure-generating means for protection thereof during downtime periods and during operation of the plant. It is suitable for the pressure of the pressure-generating means to be controlled by a torque-limited drive means. The pressure-generating means may be in the form of a pump. One example of a protective medium is an inert gas.

In an especially preferred embodiment of casting plant according to the invention, the structural members of the plant which are in contact with the molten metal, such as at least the pressure-generating means and preferably also the tube system, are made of graphite, carbon fiber-reinforced graphite, or of a ceramic material.

The invention is especially applicable to the production of aluminum castings.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
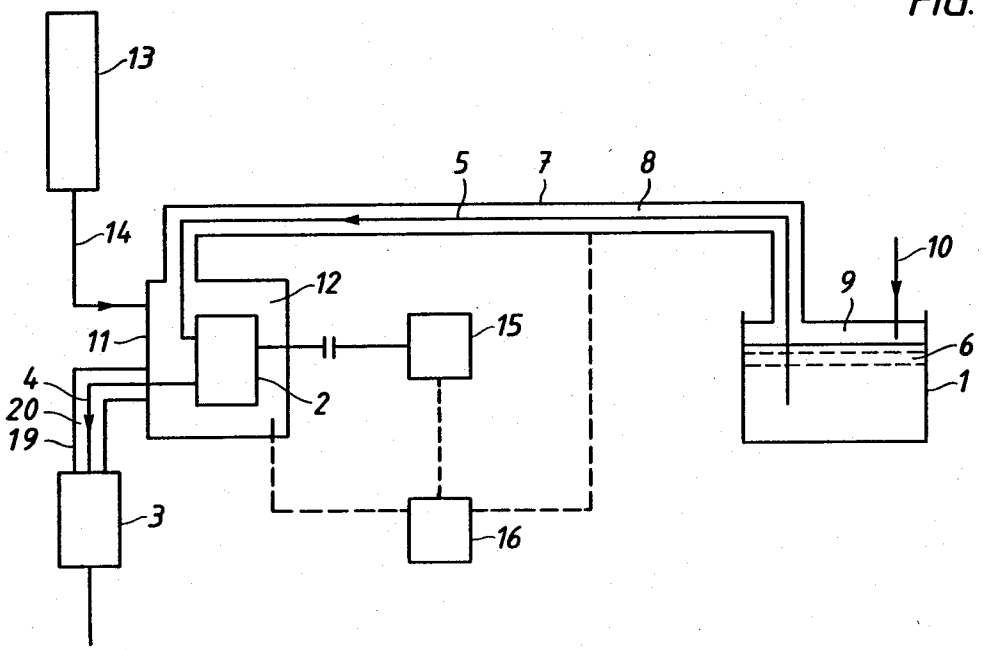
FIG. 1 shows quite schematically a preferred embodiment of the invention.

With reference to the drawing, FIG. 1 shows schematically a casting plant comprising a heated container in the form of a melting furnace 1, in which metal is maintained at the correct temperature as melt 6. Further, the casting plant comprises a pressure-generating means 2, for example a pump which forces the molten metal to a mould means 3 via a pipe 4, the pump communicating with the melting furnace 1 by means of a pipe 5 which is lowered into the melt 6 and which, in the illustrated embodiment, can be considered as a suction pipe. The pipes 5 and 4 are surrounded by heat-generating elements 7 and 19, for example annular heating elements, for accurate control of the temperature of the metal during startup and during lulls in casting. A thermally insulating layer surrounds the annular heating elements. The heat-generating elements 7, 19 are suitably electrically heated and may be of a standard type. The temperature is maintained within very close limits. Thus, the heat-generating elements result in a melt temperature which is not less than the melting point of the metal. During casting, when melt 6 is flowing through the pipes 4, 5, no energy needs to be supplied to the elements 7, 19 because of the presence of effective thermal insulation around the suction pipe 5. Between the respective pipes 5, 4 and their heat-generating elements 7, 19 spaces 8 and 20 are provided, which suitably communicate with a space 9 formed in the melting furnace 1 above its melt 6. The melting furnace 1 is fed with molten metal from a storage vessel via conduit 10.

Figure 2:
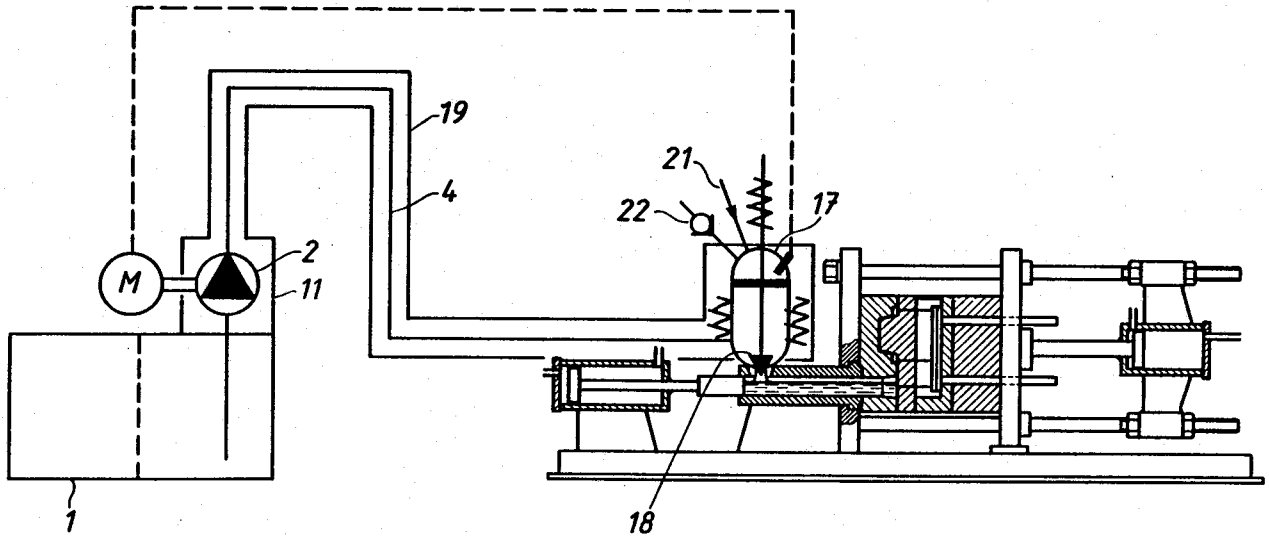
FIG. 2 shows schematically how the invention can be applied to die casting.

FIG. 2 shows, also schematically, a casting plant similar in principle to that shown in FIG. 1, but with the difference that the pipe 4 is connected to a further container 17 which in turn, when a discharge valve 18 is opened, fills the pressure chamber of a die-casting machine. The container 17 may be heated and is provided with an inlet for a gas 21. If the gas is inert, it will protect the melt from oxidation and, if the pressure of the gas is above-atmospheric, the charging time of the pressure chamber of the die-casting machine will be reduced. To prevent the pressure from becoming excessive during filling of the container 17, the latter is provided with a pressure-limiting valve 22.

The pressure-generating means 2 is adapted to the extremely difficult operating conditions created by the molten metal. The pressure-generating means results in increased pressure, which is suitably adjustable from no excess pressure to a maximum of 200 bar. The entire pressure-generating means is arranged to be heated by a heat-generating means 11 in order to maintain the metal located therein at a controlled temperature which is equal to or above its melting point. In the preferred embodiment illustrated, the heat-generating means 11 consists of a holding furnace, for example a tube-type furnace, which completely surrounds the pressure-generating means 2 and which may be of a standard type. The holding furnace 11 preferably has walls which comprise electrically heated elements enclosed in thermally insulating material. The walls define an inner space 12 which completely surrounds the pressure-generating means 2. Upon start-up of the casting plant, the pressure-generating means 2 is heated by means of the heat-generating means 11, which thus surrounds the entire pressure-generating means 2. No forced cooling need be provided in the heat-generating means 11 since the temperature can be controlled by a combination of heat input and natural cooling.

The inner space 12 within the heat-generating means 11 is able to communicate with a gas storage container 13 of an inert gas, preferably nitrogen, via a conduit 14. The inner space 12 of the heat-generating means then suitably communicates with the space 9 of the furnace 1 via the space 8 surrounding the suction pipe 5. The inert gas suitably has a small overpressure inside the holding furnace 11 and fills the inner space 12 which surrounds the pressure-generating means 2 so as to prevent oxidation thereof. These extraordinary measures must be taken when the pressure-generating means 2 consists of a material which at a high temperature reacts with oxygen in the atmosphere. Since the suction pipe 5 is surrounded by a space 8, which is filled with inert gas, oxidation of the suction pipe 5 is also prevented. Similarly, the melt 6 in the furnace 1 is prevented from oxidizing on its surface since the surface is in contact with the inert gas which is present in the space 9.

The pressure-generating means 2 can be driven by a drive means 15 of many different types. According to one preferred embodiment, the pump means consists of a d.c. motor, which has a facility permitting the torque generated by the motor to be limited (e.g. by means of a potentiometer) and thus to limit the pressure that is generated by the pressure-generating means 2. In this way the pump pressure from the pressure-generating means 2 is controlled by a motor whose torque is limited.

The casting plant illustrated in FIG. 1 further comprises a control system 16, which is arranged to supervize that a torque set in the drive means 15 is not exceeded, and that the temperatures of the pipes 4, 5 and the pressure-generating means 2 are in the correct ranges. In addition, the control system 16 may be arranged to give a visual indication of how a variety of different functions of the casting plant are being performed.

Molten aluminum is particularly aggressive to the structural members with which it comes into contact. However, it has been established that the resistance of the structural members to such attack can be considerably improved by making them of graphite, carbon fiber-reinforced graphite, or of a ceramic material. The structural members referred to here are, primarily, the movable parts of the pressure-generating means and the housing thereof, but they also comprise the suction pipe 5 from the melting furnace 1 and the pressure pipe 4. In addition, these materials have the very important property of not becoming weakened or distorted at the high temperatures under which they are required to operate.

By the steps of controlling the temperature of the metal located in the pressure-generating means 2 and protecting the structural members from oxidation from the environment as well as from attacks by the melt, as described above, it has been possible to construct a reliable casting plant, which has a long life and which can be utilized for the range of different casting methods required. A casting plant according to the invention is therefore superior to the casting plants used up to now, which are each restricted to use with certain respective casting methods.

As will be clear from the above description and from the drawings, the molten metal is stored and fed forward in a closed system.

An essential feature of the casting plant and the method according to the invention is that little or no cooling occurs within the pressure-generating means 2 and accordingly, the pressure-generating means 2 is substantially free of any cold spots where solidification could occur. Consequently, cooling of the metal commences only after it has left the pressure-generating means 2 and preferably only after it is located in a mold means connected thereto.

With certain modifications, a casting plant according to the invention can be used to rationalize production in connection with all casting methods.

CASTING OF PROFILED RODS

In the conventional manufacture of sections or profiles, aluminum is extruded through nozzles with the aid of an hydraulic press. An aluminum blank, which is in plastic state, is put in a container of the press at a temperature of about 450° C. The proportion of the blank used for production of shaped material is low, typically around 50%, and the percentage of rejection is often high, typically around 70%. It is true that a relatively high strength of the extruded rod is obtained by this method, but in the majority of cases, around 90%, the high strength values obtained are not required, since the aluminum is most frequently used for decorative purposes (e.g. for decorative moldings and the like).

With a casting plant according to the present invention, the casting of, for example, aluminum rods is performed continuously and molten aluminum is drawn from the melting furnace 1 directly to the pump 2, or other pressure-generating means, and is expelled in molten state through a nozzle. The interior of the nozzle is shaped to give the desired final sectional form. A cooling tube is mounted around the nozzle, so that the mantle of the nozzle can be cooled by water. The material therefore solidifies in the nozzle, but in certain cases molten metal may be left in the interior of the section being produced. This makes it necessary to provide an additional cooling zone downstream of the nozzle. To facilitate the removal of the shaped bar from the nozzle, a drawing unit is required downstream of the cooling zone to draw the bar out of the nozzle.

Because the motor 15 of the pressure-generating means 2 is torque-limited and the torque is adjustable, the pressure in the means 2 can be controlled. The motor which drives the drawing unit, on the other hand, is speed-controlled. This means that the linear speed at which rod is cast is set by means of the drawing unit motor and that the torque of the pump motor is set so that the pump acts to keep the nozzle full of molten metal at the rate at which the drawing unit motor advances the bar from the downstream end of the nozzle.

From the moment when the bar has left the drawing unit, the casting machine can be supplemented with a conveyor and synchronized cut-off trolley which incorporates a cutting member. The cutting member (or saw) cuts the bar to the desired lengths, which can be pre-set on a counter. Thereafter, the cut bar is transported to one side of the nozzle axis so that the bar can be stretched in a stretching mill in a conventional manner. The entire procedure is thus continuous, a condition for securing efficient production.

SAND CASTING

The production of moldings by sand castings is performed by pouring aluminum by means of a ladle into a sand mold. With the aid of a casting machine according to the present invention, the procedure is considerably rationalized and the quality of the castings is also improved. With the conventional method, oxygen in the atmosphere comes into contact with the aluminum in the furnace, in the ladle and when the melt is poured into the mold. When using a casting machine according to the present invention, a mobile unit can be used which houses both the furnace with its melt and the other necessary components. This mobile unit can then be transported, possibly on rails, to the respective mold. At the mold the outlet tube of the machine is connected to the inlet or "gate", of the mold, and the casting can be performed with a minimum contact between the aluminum and the atmosphere. By having a speed-controlled pump motor, the mold can be filled very uniformly for each casting operation, which ensures that good quality product is produced each time. The operator starts the pump by pressing a start button and when the mold is properly filled, the button can be released.

When the melting furnace 1 is empty, the casting machine can be moved to a filling location, and a new charge of melt can be filled into the holding furnace 1.

CHILL CASTING

Chill casting is performed, in principle, in the same way as sand casing, but with the difference that the casting machine may be stationary and the molds can be moved to it along a casting path. The molds are then placed on a transport line and transported automatically to the casting machine, which is stationary. The operator applies the outlet of the machine above the gate of each mold in turn and presses the start button to fill each mold. The entire procedure can be automated by using known techniques, and since the same amount of melt is required for each mold, the filling of the molds can also be automated.

LOW PRESSURE CASTING

In low pressure casting with a casting machine according to the present invention, the desired pump pressure is controlled by setting the torque of the pump motor 15. With the aid of the control system 16, it is also possible to control the desired pressure so that this is different at different times during the casting process.

HIGH PRESSURE CASTING

During die casting or high pressure casting, a casting machine according to the present invention as shown in FIG. 2 can be used in such way that its pump 2 fills the container 17 above the pressure chamber in the die casting machine with the correct amount of melt. The method can be performed fully automatically by means of a control system. The correct amount of molten metal is ensured by, for example, a revolution counter on the pump. The container 17 is Then emptied into the pressure chamber through the discharge valve 18.

Since extrusion of sectional (profiled) bars is a discontinuous process with low availability and high rejection rates, a method which is continuous and which involves high utilisation of melt and low rejection rates will give rise to a considerable improvement in productivity. This casting process is probably the least developed method in foundry work. The considerable amount of manual labor which is still carried out in foundries can be substantially reduced using the invention and at the same time the working environment can be improved with consequent improvements in occupational safety and health of the operators. From an economic point of view, the investment costs in the manufacture of sections will be considerably lower than for a known hydraulic press. Also the requisite labor force will probably be reduced. For the foundry there will, of course, be an extra investment in the casting machines, but this cost will in all probability be relative very small.

It is to be expected that further uses of the invention will be found and that many modifications can be made to the arrangements described above. These further uses and modifications falling within the spirit and scope of the following claims are to be seen as further aspects of this invention.

I claim:

1. A method in the production of a metal casting which involves feeding metal in molten state from a heated container to a further container via a pressure pipe, a pressure-generating means and a suction pipe, characterized in that the temperature of the metal present in the pressure-generating means in controlled by a heat-generating means in order to maintain the metal at a temperature which is not lower than its melting point, in that the metal is present in molten state during its passage through the pressure-generating means and through the pipes, and in that inert gas surrounds the pressure-generating means and said pipes to protect the same against oxidation.

2. A method according to claim 1, in which the pressure generated by the pressure-generating means is controlled by a torque-limited drive means.

3. A method according to claim 2, in which a torque set in the drive means is monitored by a control system.

4. A method according to claim 1, in which the molten metal is forced by the pressure-generating means into the further container which is in the form of a mold for the manufacture of a casting directly therein.

5. A method according to claim 1, in which the molten metal is forced by the pressure-generating means into the further container, the further container being provided with a discharge valve leading to the pressure chamber of a die casting mold.

6. A method according to claim 5, in which the rate of discharge from the further container is increased by introducing a gas, under pressure, above the surface of the melt in the further container.

7. A method according to claim 6, in which the oxidation of the surface of the melt in the further container is prevented by making the gas introduced into the further container an inert gas.

8. A method according to claim 6, in which the maximum gas pressure above the surface of the melt in the further container is limited by a pressure-limiting valve.

9. A method according to claim 8, in which the rate of outflow of melt from the further container is controlled by controlling the pressure of the gas acting on the surface of the melt in the further container.

10. A method in the production of a metal casting which involves feeding metal in molten state from a heated container to a further container via a pressure pipe, a pressure-generating means and a suction pipe, the temperature of the metal present in the pressure-generating means being controlled by a heat-generating means in order to maintain the metal at a temperature which is not lower than its melting point, characterized in that the metal is present in molten state durings its passage through the pressure-generating means and through the pipes, in that an inert gas protective medium completely surrounds at least the pressure-generating means, and in that the pressure-generating means is controlled by a torque-limited drive means.

11. A casting plant for the production of a metal casting, comprising a heated container for molten metal and a pressure-generating means, which is fed with molten metal from said container via a suction pipe, a further container and a pressure pipe through which molten metal is fed by said pressure-generating means to said further container, the plant including a heat-generating means arranged to control the temperature of the metal present in the pressure-generating means in order to maintain the metal at a temperature not less than the melting point of the metal, and means defining a space containing inert gas which surrounds said pressure-generating means and said pipes to protect the same against oxidation.

12. A casting plant according to claim 11, wherein said heat-generating means comprises a holding furnace which completely surrounds the pressure-generating means defines said space therearound, and communicates with said space defining means surrounding said pipes.

13. A casting plant according to claim 11, wherein said pressure-generating means and said pipes which are in contact with the molten metal are made of one of graphite, carbon fiber-reinforced graphite and a ceramic material.

14. A casting plant according to claim 12, wherein said pressure-generating means and said pipes which are in contact with the molten metal are made of one of graphite, carbon fiber-reinforced graphite and a ceramic material.

* * * * *